US010539099B2

(12) United States Patent
Yoon et al.

(10) Patent No.: US 10,539,099 B2
(45) Date of Patent: Jan. 21, 2020

(54) COOLER FOR VEHICLE

(71) Applicants: HYUNDAI MOTOR COMPANY, Seoul (KR); KIA MOTORS CORPORATION, Seoul (KR)

(72) Inventors: Sung Il Yoon, Seoul (KR); Dong Young Lee, Goyang-Si (KR); Do Jun Pak, Hwaseong-Si (KR); Seogjin Yoon, Suwon-Si (KR); In Sung Yun, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/033,532

(22) Filed: Jul. 12, 2018

(65) Prior Publication Data

US 2019/0186428 A1 Jun. 20, 2019

(30) Foreign Application Priority Data

Dec. 19, 2017 (KR) ..... 10-2017-0175226

(51) Int. Cl.
*F28F 9/02* (2006.01)
*F02M 26/11* (2016.01)
(Continued)

(52) U.S. Cl.
CPC ..... *F02M 26/11* (2016.02); *F02M 26/32* (2016.02); *F28F 1/40* (2013.01); *F28F 9/0246* (2013.01);
(Continued)

(58) Field of Classification Search
CPC ..... F28F 19/06; F28F 21/084; F28F 21/089; F02M 26/11
See application file for complete search history.

(56) References Cited

U.S. PATENT DOCUMENTS

2016/0298914 A1* 10/2016 Kanno ..... B23K 1/00

FOREIGN PATENT DOCUMENTS

DE 10 2007 029 339 A1 12/2017
EP 2 832 873 A1 2/2015
(Continued)

OTHER PUBLICATIONS

Extended European Search Report issued in European Application No. 18179815.8 dated Dec. 14, 2018.

*Primary Examiner* — Jonathan R Matthias
(74) *Attorney, Agent, or Firm* — Morgan, Lewis & Bockius LLP

(57) ABSTRACT

A cooler for a vehicle includes: a cooler housing; tubes disposed inside the cooler housing; cooling pins arranged inside the tubes in a predetermined pattern; and a cup plate attached to both ends of the cooler housing, including a first core material and a first bonding layer bonded at both outer surfaces of the first core material, and having a plurality of slots penetrating the first bonding layer and the first core material in a thickness direction. Each of the tube has an end part penetrating each of the slots and includes a second core material and a second bonding layer that is in contact with an interior surface of the slots, the second bonding layer is in contact with the first bonding layer and the first core material, and the first bonding layer includes a material having a corrosion potential lower than that of the second bonding layer.

7 Claims, 3 Drawing Sheets

(51) Int. Cl.

| | |
|---|---|
| ***F28F 1/40*** | (2006.01) |
| ***F02M 26/32*** | (2016.01) |
| ***F28F 19/06*** | (2006.01) |
| ***F28F 21/08*** | (2006.01) |
| ***F28F 9/18*** | (2006.01) |

(52) U.S. Cl.
CPC ..... *F28F 9/18* (2013.01); *F28F 19/06* (2013.01); *F28F 21/089* (2013.01)

(56) References Cited

FOREIGN PATENT DOCUMENTS

| | | | |
|---|---|---|---|
| EP | 3 059 329 | A1 | 8/2016 |
| JP | 3151152 | B2 | 4/2001 |
| JP | 4432229 | B2 | 3/2010 |
| KR | 10-0624372 | B1 | 9/2006 |
| KR | 10-1396457 | B1 | 5/2014 |
| WO | 2009/044947 | A1 | 4/2009 |
| WO | 2012/066115 | A1 | 5/2012 |
| WO | 2016/167477 | A1 | 10/2016 |

* cited by examiner

COOLER FOR VEHICLE

CROSS-REFERENCE TO RELATED APPLICATION

This application claims priority to and the benefit of Korean Patent Application No. 10-2017-0175226 filed in the Korean Intellectual Property Office on Dec. 19, 2017, the entire contents of which are incorporated herein by reference.

TECHNICAL FIELD

The present disclosure relates to a cooler for a vehicle. More particularly, the present disclosure relates to a cooler for a vehicle for improving a corrosion resistance by preventing a corrosion of a tube applied to a cooler.

BACKGROUND

Recently, environmental problems such as global warming have emerged and regulations on an exhaust gas have been strengthened.

In particular, strict standards for an exhaust amount of an automobile exhaust gas are applied in actual circumstances.

Therefore, a technique to reduce a harmful material of the vehicle exhaust gas has been developed, for example, there is an exhaust gas recirculation (EGR) apparatus.

This exhaust gas recirculation apparatus reticulates a part of the exhaust gas exhausted from the engine into the intake line, thereby having a function reducing an oxygen amount in a mixture, reducing an exhaust amount of the exhaust gas, and reducing a harmful material in the exhaust gas.

Further, the exhaust gas recirculation apparatus includes a cooler cooling the exhaust gas.

In this case, the cooler has cooling water passage through which cooling water passes and a tube through which the exhaust gas passes.

The cooler functions as a kind of a heat exchanger that performs heat exchange between the exhaust gas and the cooling water so as to prevent an excess gas temperature rising in the exhaust gas.

These coolers may be made of an aluminum alloy material of which heat transfer efficiency formed by the exhaust gas is high a formability is good.

However, in the cooler according to a conventional art, there is a problem that a penetration hole is generated in the tube vulnerable to the corrosion by corrosion ions such as Cl—, SO42-, NO3-, etc. contained in a condensed water component.

There is a problem that a leakage phenomenon of the exhaust gas occurs through the penetration hole and a cooler efficiency is deteriorated.

The above information disclosed in this Background section is only for enhancement of understanding of the background of the invention and therefore it may contain information that does not form the prior art that is already known in this country to a person of ordinary skill in the art.

SUMMARY

An exemplary embodiment of the present disclosure provides a cooler for a vehicle for applying a first bonding layer made of a corrosion potential lower than a corrosion preventing layer of a tube to a cap plate inserted to a front end of the tube and being disposed to be exposed outside so that the first bonding layer is induced to be firstly corroded, thereby suppressing the corrosion of the tube.

In an exemplary embodiment of the present disclosure, a cooler for a vehicle comprises: a cooler housing having a cooling water passage; tubes having exhaust gas passages inside the cooler housing; cooling pins arranged inside the tubes in a predetermined pattern; a cup plate attached to both ends of the cooler housing, including a first core material and a first bonding layer bonded at both outer surfaces of the first core material, and having a plurality of slots penetrating the first bonding layer and the first core material in a thickness direction. Each of the tubes has an end part penetrating each of the slots and includes a second core material and a second bonding layer that is in contact with an interior surface of each of the slots, the second bonding layer is in contact with the first bonding layer and the first core material, and the first bonding layer includes a material having a corrosion potential lower than that of the second bonding layer.

The cup plate may be formed of a clad material of a three-layered structure in which the second bonding layer of A4000 series is bonded on both surfaces of the first core material of A3000 series.

In the tube, a diffusion preventing layer of A1000 series may be respectively bonded on both surfaces of the second core material of A3000 series, and the second bonding layer of A4000 series may be respectively bonded on each exterior surface of the diffusion preventing layer.

The first bonding layer may be formed of A4045 material, and the second bonding layer may be formed of A4343 material.

The cooler for the vehicle according to one or a plurality of exemplary embodiment of the present disclosure may further include a support disposed to maintain a predetermined distance of the tube at a cooling water passage between the tubes.

An intake pipe and an exhaust pipe respectively connected to the cooler housing and in which a cooling water inflows and is exhausted may be further included.

Each of the cooling pins may have a concavo-convex shape in which a plurality of concave portions and convex portions are connected.

As an exemplary embodiment of the present disclosure applies the first bonding layer made of the corrosion potential lower than the second bonding layer of the tube at the cup plate and disposes it to be exposed outside, the first bonding layer is guided to be firstly corroded, thereby there is an effect suppressing the corrosion of the tube.

Further, effects that can be obtained or expected from exemplary embodiments of the present disclosure are directly or suggestively described in the following detailed description. That is, various effects expected from exemplary embodiments of the present disclosure will be described in the following detailed description.

DETAILED DESCRIPTION OF THE EMBODIMENTS

Figure 1:
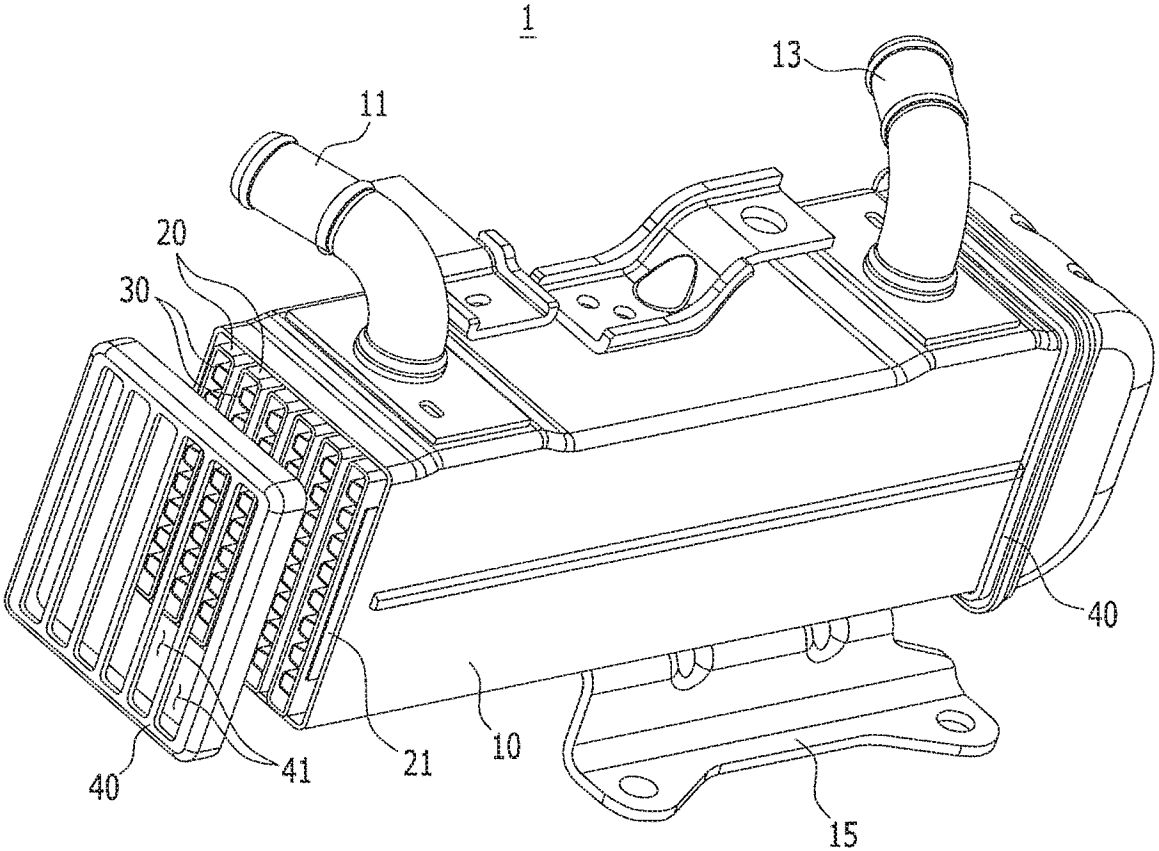
FIG. 1 is an exploded perspective view of a cooler for a vehicle according to an exemplary embodiment of the present disclosure.

The present disclosure will be described more fully hereinafter with reference to the accompanying drawings, in which exemplary embodiments of the invention are shown. As those skilled in the art would realize, the described embodiments may be modified in various different ways, all without departing from the spirit or scope of the present disclosure.

The drawings and description are to be regarded as illustrative in nature and not restrictive, and like reference numerals designate like elements throughout the specification.

Figure 2:
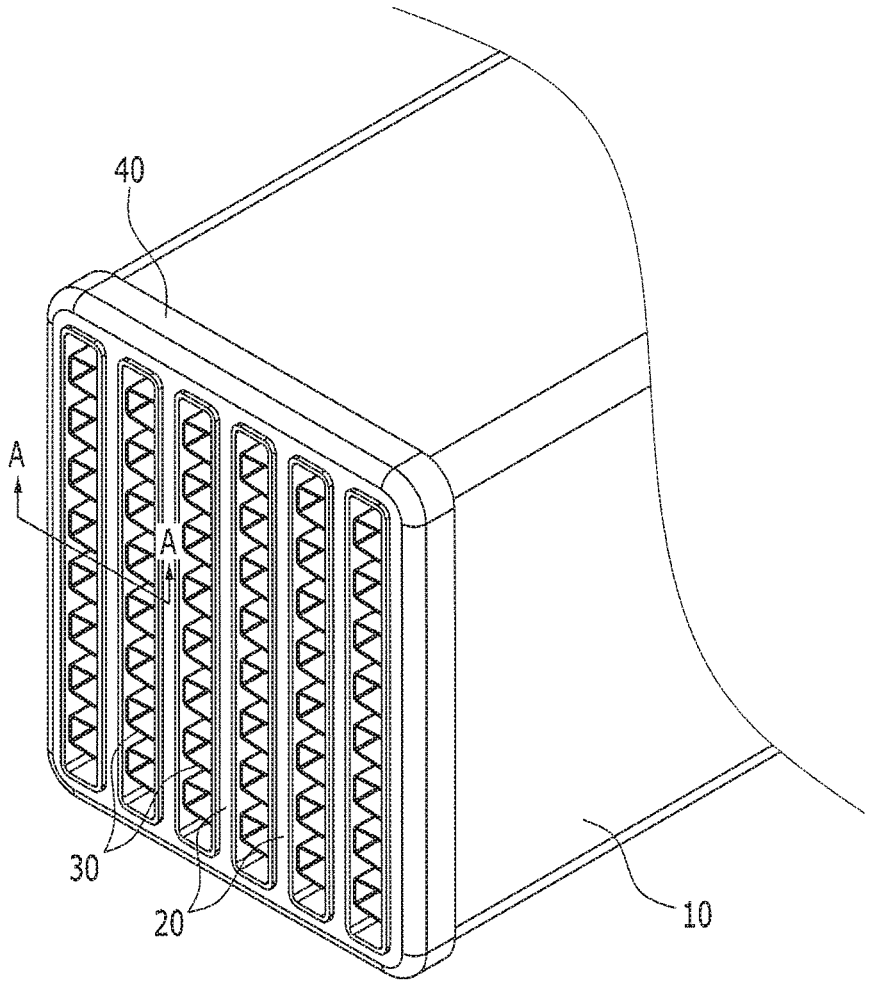
FIG. 2 is an assembly enlarged view of a cooler for a vehicle according to an exemplary embodiment of the present disclosure.
Figure 3:
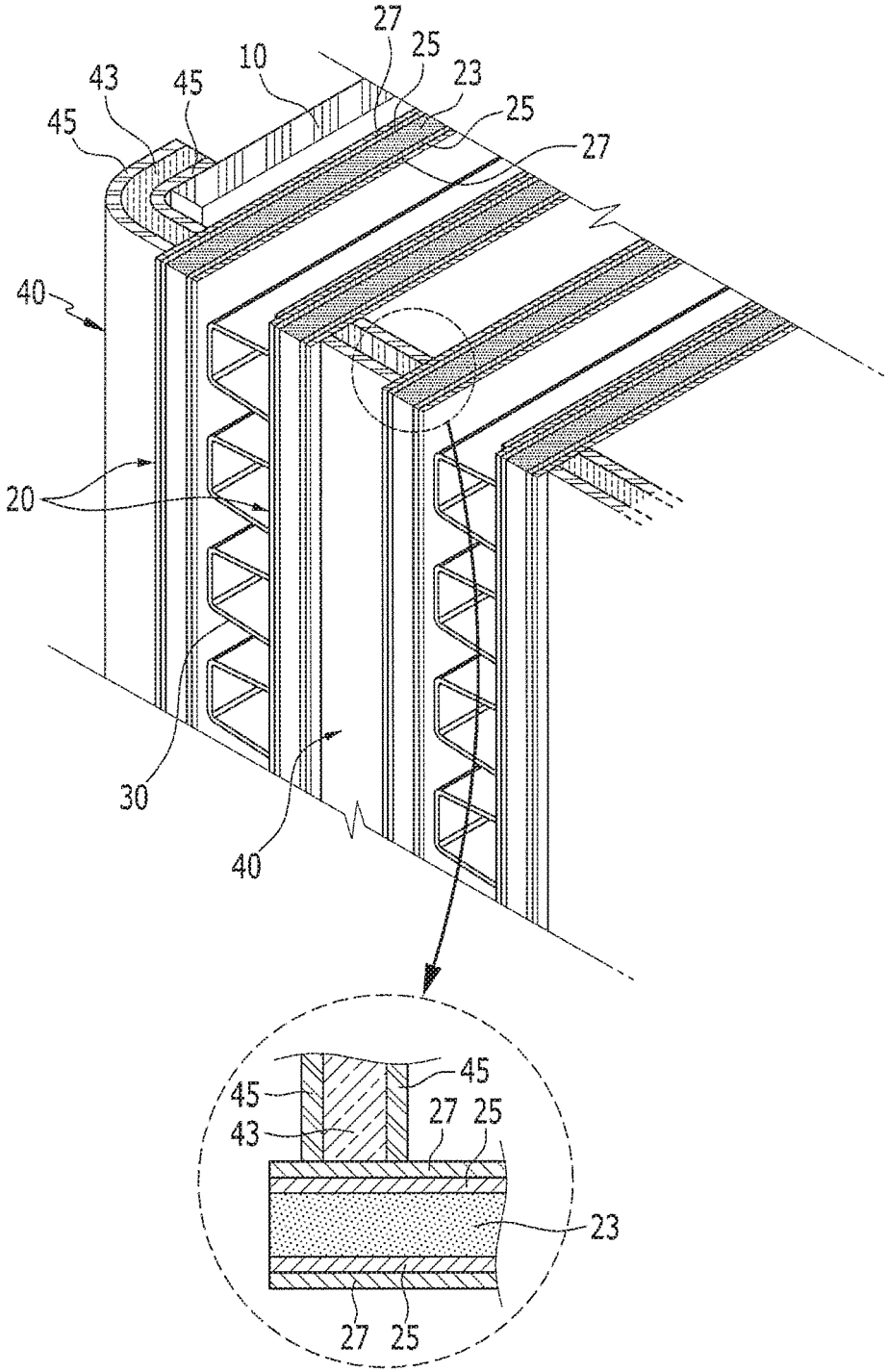
FIG. 3 is a cross-sectional view taken along a line A-A of FIG. 2.

FIG. 1 is an exploded perspective view of a cooler for a vehicle according to an exemplary embodiment of the present disclosure, FIG. 2 is an assembly enlarged view of a cooler for a vehicle according to an exemplary embodiment of the present disclosure, and FIG. 3 is a cross-sectional view taken along a line A-A of FIG. 2.

Referring to FIG. 1 and FIG. 2, a cooler for a vehicle 1 according to an exemplary embodiment of the present disclosure relates to a cooler for an exhaust gas recirculation (EGR) apparatus cooling an exhaust gas recirculated from an exhaust line to an intake line among an exhaust system of an engine.

The EGR cooler 1 (hereinafter; referred to as 'a cooler') cools a recirculated exhaust gas by using a cooling water.

Also, a structure of the cooler 1 according to an exemplary embodiment of the present disclosure may be applied to various heat exchangers as well as the exhaust gas recirculation apparatus.

The cooler 1 includes a cooler housing 10, a tube 20, a cooling pin 30, and a cup plate 40.

First, the cooler housing 10 has a square cross section as a whole, an intake pipe 11 is connected to one side of the upper surface, and an exhaust pipe 13 is connected to the other side, respectively.

The cooler housing 10 forms a cooling water passage inside, and the cooling water flows and is exhausted through the intake pipe 11 and the exhaust pipe 13. In the cooler housing 10, a mounting bracket 15 is bonded at a lower surface.

The cup plate 40 is inserted to both side ends of the cooler housing 10. Further, in the cup plate 40, a slot 41 is formed in a direction that the tube 20 is disposed to penetrate a front end part of the tube 20 with a predetermined section.

The cup plate 40 includes a plurality of clad materials.

In the cup plate 40, referring to FIG. 3, a first bonding layer 45 of A4000 series is bonded to both surfaces of a first core material 43 of A3000 series.

That is, in the cup plate 40, the first bonding layers 45 are bonded to both outside surfaces, the first core material 43 is interposed between the first bonding layers 45, and the plurality of the slots 41 are formed in a thickness direction that the first bonding layer 45 and the first core material 43 are penetrated.

In the present disclosure, the tube 20 may be provided in plural inside the cooler housing 10 with a predetermined interval and form an exhaust gas passage inside the cooler 1. Here, a support 21 may be disposed between the plurality of tubes 20 so as to maintain a predetermined distance.

The tube 20 may be formed of a tubular shape with a rectangle cross section, and may include a plurality of clad materials.

Referring to FIG. 3, each clad material of the tube 20 includes a second core material 23 of A3000 series and a second bonding layer 27 of A4000 series at an interior surface of the slot 41 and an inside surface in contact with the exhaust gas.

The second bonding layer 27 is respectively bonded to the outside surface in contact with the interior surface of the slot 41 of the cup plate 40 and the inside surface in contact with the exhaust gas passage inside.

A diffusion preventing layer 25 of A1000 series is bonded to both surfaces of the second core material 23.

The second core material 23 is formed of a material of A3000 series made of an aluminum-manganese (Al—Mn) alloy, for example, it may be A0328 material.

The diffusion preventing layer 25 is formed of a material of A1000 series made of a pure aluminum, for example, it may be A0140 material.

The second bonding layer 27 is formed of a material of A4000 series made of an aluminum-silicon (Al—Si) alloy, for example, it may be A4343 material.

The cooling pin 30 is bonded between the tubes 20 with a predetermined pattern, thereby defining the exhaust gas passage. The cooling pin 30 may have a concavo-convex shape in which a plurality of concave portions and convex portions are connected. The cooling pin 30 may be designed with a shape that may maximize the area of the exhaust gas passage.

Here, the first bonding layer 45 is formed of a material having the corrosion potential lower than the corrosion potential of the second bonding layer 27 of the tube 20.

That is, the first bonding layer 45 of the cup plate 40 to prevent the corrosion of the tube 20 is made of the material having the low corrosion potential so that the corrosion is guided to be done before the second bonding layer 27 of the tube 20, thereby having a function suppressing the corrosion of the tube 20.

In detail, the first core material 43 is formed of the material of A3000 series made of the aluminum-manganese (Al—Mn) alloy, for example, it may be A3003 material.

The first bonding layer 45 is formed of the material of A4000 series made of the aluminum-silicon (Al—Si) alloy, for example, it may be A4045 material.

As above-described, as the clad material of three steps of the cup plate 40 is bonded in the direction vertical to the bonding direction of the clad material of five steps of the tube 20, the second bonding layer 27 bonded with the interior surface of the slot 41 is disposed to be in contact with the first core material 43 and the first bonding layer 45.

In other words, the cup plate 40 is vertical to the bonding direction that the cup plate 40 is bonded to each clad material of the tube 20 so that the second bonding layer 45 of the cup plate 40 is exposed outside.

Accordingly, the cooler for the vehicle 1 according to an exemplary embodiment of the present disclosure applies the first bonding layer 45 guiding the corrosion to the cup plate 40 inserted to the end part of the tube 20, thereby preventing the corrosion of the tube 20.

That is, in the cooler for the vehicle 1, as the first bonding layer 45 made of the corrosion potential lower than the second bonding layer 27 of the tube 20 is applied to the cup plate 40 and is disposed to be exposed outside, the first bonding layer 45 is guided to be firstly corroded, thereby suppressing the corrosion of the tube 20.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. A cooler for a vehicle comprising:

a cooler housing having a cooling water passage therein;

tubes disposed inside the cooler housing and having exhaust gas passages therein;

cooling pins arranged inside each of the tubes in a predetermined pattern; and a cup plate attached to both ends of the cooler housing, including a first core material and a first bonding layer that is bonded to both outer surfaces of the first core material, and having a plurality of slots penetrating the first bonding layer and the first core material in a thickness direction, wherein each of the tubes has an end part penetrating each of the plurality of slots and includes a second core material and a second bonding layer that is in contact with an interior surface of each of the plurality of slots, wherein the second bonding layer is in contact with the first bonding layer and the first core material, and wherein the first bonding layer includes a material having a corrosion potential lower than that of the second bonding layer.

2. The cooler for the vehicle of claim 1, wherein the cup plate has a clad material having a three-layered structure of which the first bonding layer having A4000 series is bonded on both surfaces of the first core material.

3. The cooler for the vehicle of claim 1, wherein each of the tubes includes a diffusion preventing layer having A1000 series is respectively bonded on both surfaces of the second core material, and wherein the second bonding layer is respectively bonded on each exterior surface of the diffusion preventing layer.

4. The cooler for the vehicle of claim 1, wherein the first bonding layer includes A4045 material, and wherein the second bonding layer includes A4343 material.

5. The cooler for the vehicle of claim 1, further comprising:

supports disposed between the tubes to maintain a predetermined distance between each of the tubes.

6. The cooler for the vehicle of claim 1, further comprising:

an intake pipe and an exhaust pipe connected to the cooler housing, through which a cooling water inflows and is exhausted, respectively.

7. The cooler for the vehicle of claim 1, wherein:

each of the cooling pins has a concavo-convex shape having a plurality of concave portions and convex portions connected to each other.

* * * * *